US011735807B2

(12) United States Patent
Huang et al.

(10) Patent No.: US 11,735,807 B2
(45) Date of Patent: Aug. 22, 2023

(54) ANTENNA MODULE AND ELECTRONIC DEVICE

(71) Applicant: VIVO MOBILE COMMUNICATION CO., LTD., Guangdong (CN)

(72) Inventors: Huan-Chu Huang, Guangdong (CN); Xianjing Jian, Guangdong (CN); Rongjie Ma, Guangdong (CN); Yijin Wang, Guangdong (CN)

(73) Assignee: Vivo Mobile Communication Co., Ltd., Guangdong (CN)

( * ) Notice: Subject to any disclaimer, the term of this patent is extended or adjusted under 35 U.S.C. 154(b) by 47 days.

(21) Appl. No.: 17/671,877

(22) Filed: Feb. 15, 2022

(65) Prior Publication Data

US 2022/0173495 A1 Jun. 2, 2022

Related U.S. Application Data

(63) Continuation of application No. PCT/CN2020/107089, filed on Aug. 5, 2020.

(30) Foreign Application Priority Data

Aug. 16, 2019 (CN) ..... 201910760335.6

(51) Int. Cl.

| | |
|---|---|
| ***H01Q 1/22*** | (2006.01) |
| ***H01Q 19/17*** | (2006.01) |
| ***H01Q 21/00*** | (2006.01) |

(52) U.S. Cl.

CPC ..... *H01Q 1/2283* (2013.01); *H01Q 19/17* (2013.01); *H01Q 21/0025* (2013.01)

(58) Field of Classification Search

CPC ..... H01Q 1/2283; H01Q 19/17

(Continued)

(56) References Cited

U.S. PATENT DOCUMENTS

| | | | | |
|---|---|---|---|---|
| 10,892,564 | B1 * | 1/2021 | Huang | H01Q 21/08 |
| 2017/0005408 | A1 | 1/2017 | Gomadam et al. | |

(Continued)

FOREIGN PATENT DOCUMENTS

| | | | |
|---|---|---|---|
| CN | 105490006 | A | 4/2016 |
| CN | 106469854 | A | 3/2017 |

(Continued)

OTHER PUBLICATIONS

El-Halwagy et al., "Fence Shaping of Substrate Integrated Fan-Beam Electric Dipole for High-Band SG", MDPI, May 15, 2019.

(Continued)

*Primary Examiner* — Peguy Jean Pierre

(74) *Attorney, Agent, or Firm* — Price Heneveld LLP

(57) ABSTRACT

An antenna module and an electronic device are provided. The antenna module includes: a substrate, including a floor, a first dielectric layer, and a second dielectric layer, where the first dielectric layer and the second dielectric layer are located on two sides of the floor, respectively; a millimeter wave antenna array, including N dipole antenna units, where the N dipole antenna units are successively disposed in the substrate at an interval along the substrate, and N is an integer greater than 1; a radio frequency integrated circuit, where the radio frequency integrated circuit is disposed on the first dielectric layer and is connected to feeding structures of the N dipole antenna units; and a non-millimeter wave antenna, where the non-millimeter wave antenna is disposed on the second dielectric layer.

20 Claims, 7 Drawing Sheets

(58) Field of Classification Search
USPC ..... 343/817
See application file for complete search history.

(56) References Cited

U.S. PATENT DOCUMENTS

| | | | | |
|---|---|---|---|---|
| 2017/0110787 | A1* | 4/2017 | Ouyang | H01Q 1/42 |
| 2017/0201014 | A1 | 7/2017 | Lee et al. | |
| 2019/0109387 | A1 | 4/2019 | Samadi Taheri et al. | |
| 2020/0304216 | A1* | 9/2020 | Cooper | H01Q 21/062 |
| 2020/0350696 | A1 | 11/2020 | Zhu et al. | |
| 2022/0140473 | A1 | 5/2022 | Ma et al. | |

FOREIGN PATENT DOCUMENTS

| | | | |
|---|---|---|---|
| CN | 108886202 | A | 11/2018 |
| CN | 109687165 | A | 4/2019 |
| CN | 110086552 | A | 8/2019 |
| CN | 110534924 | A | 12/2019 |
| EP | 1229605 | A1 | 8/2002 |
| WO | 2018119153 | A2 | 6/2018 |
| WO | 2019240535 | A1 | 12/2019 |
| WO | 2020022818 | A1 | 1/2020 |
| WO | 2021013010 | A1 | 1/2021 |

OTHER PUBLICATIONS

Huawei, "Inclusion of BS antenna pattern and weights in NR UE OTA testing", 3GPP TSG RAN WG4 Meeting #84bis, R4-1711309, Dubrovnik, Croatia, Oct. 9-13, 2017.

* cited by examiner

ANTENNA MODULE AND ELECTRONIC DEVICE

CROSS REFERENCE TO RELATED APPLICATIONS

This application is a continuation application of PCT International Application No. PCT/CN2020/107089 filed on Aug. 5, 2020, which claims priority to Chinese Patent Application No. 201910760335.6 filed in China on Aug. 16, 2019, which are incorporated in their entireties by reference herein.

TECHNICAL FIELD

The present disclosure relates to the field of antenna technologies, and in particular to an antenna module and an electronic device.

BACKGROUND 5G ($5^{th}$-Generation) mobile networks have two frequency ranges: FR1 (Frequency Range 1) of 450 MHz-7.125 GHz and FR2 (Frequency Range 2) of 24.25 GHz-43 GHz. The FR1 is a non-millimeter frequency range, and the FR2 is a millimeter wave (mmWave) frequency range. A non-millimeter wave antenna and millimeter wave antenna in 5G mobile networks are designed separately. As a result, antennas as a whole occupy a larger volume.

SUMMARY

Embodiments of the present disclosure provide an antenna module and an electronic device to prevent related antennas from occupying a large volume.

The present disclosure is implemented as follows:

According to a first aspect, some embodiments of the present disclosure provide an antenna module including:

a substrate, including a floor, a first dielectric layer, and a second dielectric layer, where the first dielectric layer and the second dielectric layer are located on two sides of the floor, respectively;

a millimeter wave antenna array, including N dipole antenna units, where the N dipole antenna units are successively disposed in the substrate at an interval along a length direction of the substrate, and N is an integer greater than 1;

a radio frequency integrated circuit, where the radio frequency integrated circuit is disposed on the first dielectric layer and is connected to feeding structures of the N dipole antenna units; and a non-millimeter wave antenna, where the non-millimeter wave antenna is disposed on the second dielectric layer.

According to a second aspect, some embodiments of the present disclosure provide an electronic device including the antenna module according to the first aspect of some embodiments of the present disclosure, where a connector of the antenna module is connected to a main board of the electronic device.

In some embodiments of the present disclosure, after a millimeter wave dipole antenna array is integrated with a non-millimeter wave antenna, an integration degree of an antenna module is improved, effectively reducing overall space occupied by antennas.

BRIEF DESCRIPTION OF DRAWINGS

To describe the technical solutions in embodiments of the present disclosure more clearly, the following briefly describes the accompanying drawings required for describing the embodiments of the present disclosure. Apparently, the accompanying drawings in the following description show merely some embodiments of the present disclosure, and a person of ordinary skill in the art may still derive other drawings from these accompanying drawings without creative efforts.

DESCRIPTION OF EMBODIMENTS

Figure 1:
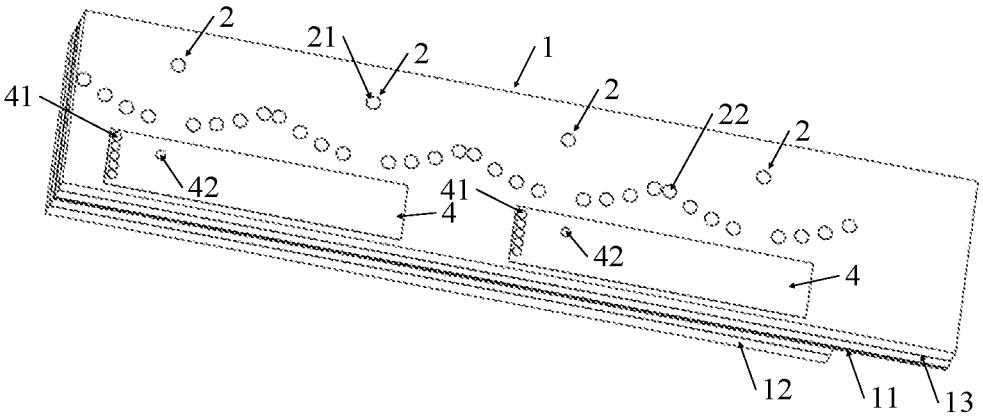
FIG. 1 is a three-dimensional structural diagram of an antenna module with its back side upward, according to some embodiments of the present disclosure.

The technical solutions in the embodiments of the present disclosure are described below clearly with reference to the accompanying drawings in the embodiments of the present disclosure. Apparently, the described embodiments are some rather than all of the embodiments of the present disclosure. All other embodiments obtained by a person of ordinary skill in the art based on the embodiments of the present disclosure without creative efforts shall fall within the protection scope of the present disclosure.

As shown in FIG. 1 to FIG. 15, some embodiments of the present disclosure provide an antenna module, including:

a substrate 1, including a floor 11, a first dielectric layer 12, and a second dielectric layer 13, where the first dielectric layer 12 and the second dielectric layer 13 are located on two sides of the floor 11, respectively;

a millimeter wave antenna array, including N dipole antenna units 2, where the N dipole antenna units 2 are successively disposed in the substrate 1 at an interval along the substrate 1, and N is an integer greater than 1;

a radio frequency integrated circuit 3, where the radio frequency integrated circuit 3 is disposed on the first dielectric layer 12 and is connected to feeding structures of the N dipole antenna units 2; and a non-millimeter wave antenna 4, where the non-millimeter wave antenna 4 is disposed on the second dielectric layer 13.

The first dielectric layer 12 and the second dielectric layer 13 are located on two sides of the floor 11, respectively. It can be understood that the first dielectric layer 12 and the second dielectric layer 13 are located on two opposite sides of a plane where the floor 11 is located. Alternatively, the first dielectric layer 12, the floor 11, and the second dielectric layer 13 are stacked in turn, and the floor 11 is disposed between the first dielectric layer 12 and the second dielectric layer 13.

The N dipole antenna units 2 may be successively disposed in the substrate 1 at an interval along a length direction of the substrate 1.

Each of the dipole antenna units 2 may be a single polarized dipole antenna, such as a vertically polarized dipole antenna or a horizontally polarized dipole antenna, or a dual polarized dipole antenna composed of a vertically polarized dipole antenna and a horizontally polarized dipole antenna. The N dipole antenna units 2 form the millimeter wave antenna array of the antenna module. It can be seen that an antenna of each dipole antenna unit 2 is a millimeter wave antenna. More specifically, a length of an antenna branch of each dipole antenna unit 2 may be set according to a wavelength of a millimeter wave. A specific structure of the dipole antenna unit 2 may be implemented in various manners, and related schemes of the dipole antenna unit 2 will be described in detail later.

The radio frequency integrated circuit (Radio Frequency Integrated Circuits, RFIC) 3, also called a radio frequency integrated chip, is configured to provide a signal source for the millimeter wave antenna array (that is, each dipole antenna unit 2). In other words, as the radio frequency integrated circuit 3 serves as a feeding source of the millimeter wave antenna array, a feeding structure of each of the dipole antenna units 2 is connected to the radio frequency integrated circuit 3. The radio frequency integrated circuit 3 is integrated with the millimeter wave antenna array, which not only helps to improve an integration degree of the antenna module, but also helps to shorten a distance between the radio frequency integrated circuit 3 and each of the dipole antenna units 2, thus shortening a feeding distance of each of the dipole antenna units 2, improving communication performance of each of the dipole antenna units 2 and overall communication performance of the millimeter wave antenna array.

It should be noted that the radio frequency integrated circuit 3 needs to be connected to the floor 11 in addition to a feeding structure of each of the dipole antenna units 2, to implement grounding of the radio frequency integrated circuit 3. Specifically, a signal pin of the radio frequency integrated circuit 3 is connected to the feeding structure of each of the dipole antenna units 2 through a transmission line (or a signal line) buried in the first dielectric layer 12, and a grounding pin of the radio frequency integrated circuit 3 is connected to the floor 11.

Figure 8:
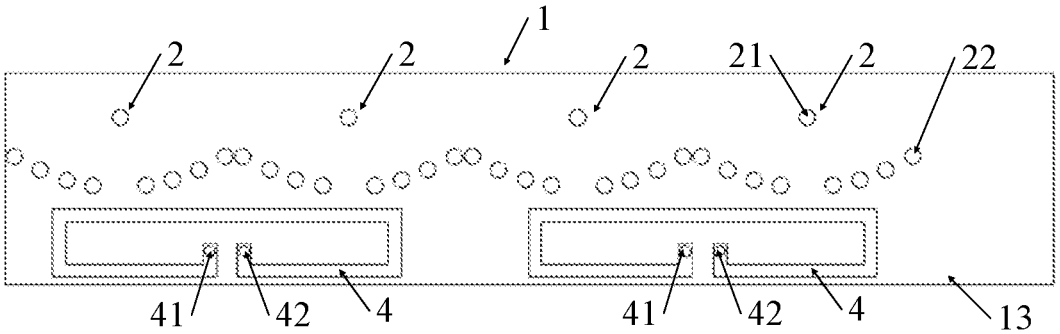
FIG. 8 is a first schematic structural diagram of an antenna module of a loop antenna according to some embodiments of the present disclosure.
Figure 9:
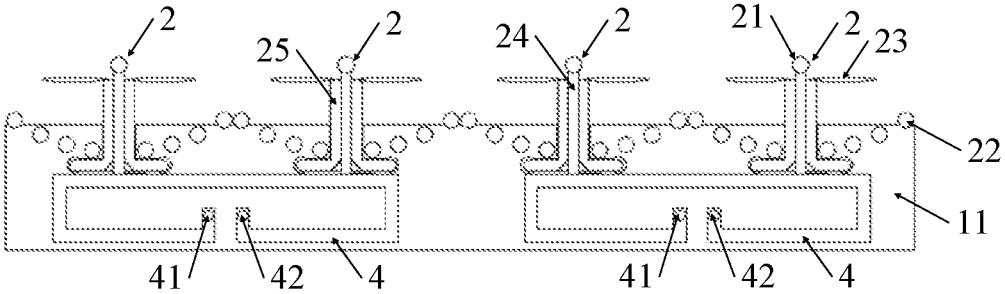
FIG. 9 is a second schematic structural diagram of the antenna module of the loop antenna according to some embodiments of the present disclosure.
Figure 15:
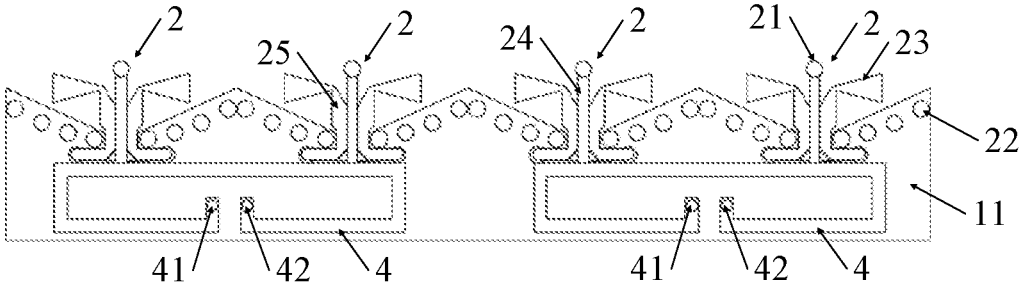

In 5G mobile networks, a non-millimeter wave frequency range is FR1, that is, the frequency range is 450 MHz-7.125 GHz. Therefore, the foregoing non-millimeter wave antenna 4 may also be called a FR1 antenna. The millimeter wave frequency range is FR2, that is, the frequency range is 24.25 GHz-43 GHz, and so the millimeter wave antenna array may also be called a FR2 antenna array. The non-millimeter wave antenna 4 may be a patch antenna, a planar inverted-F antenna (Planar Inverted-F Antenna, PIFA) as shown in FIG. 1, FIG. 4, FIG. 6, and FIG. 13, or a loop antenna as shown in FIG. 8, FIG. 9, and FIG. 15. If it is the patch antenna, there is no need to set a grounding via.

When the non-millimeter wave antenna 4 is the planar inverted-F antenna, the overall size of the non-millimeter wave antenna 4 is relatively large. When the non-millimeter wave antenna 4 is the loop antenna, the overall size of the non-millimeter wave antenna 4 is relatively small. A grounding point 41 and a feeding point 42 may be disposed on the non-millimeter wave antenna 4. When the non-millimeter wave antenna 4 is the loop antenna, the grounding point 41 and the feeding point 42 may be disposed at both ends of the loop antenna.

In some embodiments of the present disclosure, the radio frequency integrated circuit 3 and the non-millimeter wave antenna 4 are disposed on the first dielectric layer 12 and the second dielectric layer 13, respectively, so that the radio frequency integrated circuit 3 and the non-millimeter wave antenna 4 may be separated by the floor 11, which helps to prevent signals in 1-R1 and millimeter wave signals in FR2 from interfering with each other. Optionally, shielding covers may be disposed for the radio frequency integrated circuit 3 and a power management integrated circuit, so as to further prevent signals in FR1 and millimeter wave signals in FR2 from interfering with each other and improve communication performance of the antenna module. The shielding cover may further act as a reflector of a millimeter wave antenna, so that a radiation direction of the millimeter wave antenna is an end-fire direction.

Generally, a bandwidth of an antenna is positively related to a volume of the antenna. To improve a bandwidth of the non-millimeter wave antenna 4, a height of the non-millimeter wave antenna 4 may be appropriately increased, and a distance between the non-millimeter wave antenna 4 and the floor 11 may further be increased accordingly. Therefore, the distance between the non-millimeter wave antenna 4 and the floor 11 may be larger than a distance between the radio frequency integrated circuit 3 and the floor 11. To meet the height requirement of the non-millimeter wave antenna 4, a thickness of the first dielectric layer 12 may further be different from that of the second dielectric layer 13. For example, the thickness of the second dielectric layer 13 may be greater than that of the first dielectric layer 12.

Optionally, the non-millimeter wave antenna 4 may be flush with an outer surface of the second dielectric layer 13, or the non-millimeter wave antenna 4 may be flush with a surface of the second dielectric layer 13 facing away from the floor 11. Alternatively, a surface of the non-millimeter wave antenna 4 away from the floor 11 may be flush with a surface of the second dielectric layer 13 away from the floor 11, so as to improve integrity and compactness of the antenna module.

Because the non-millimeter wave antenna 4 has a long wavelength, its signal energy is not easily to fade. Therefore, the non-millimeter wave antenna 4 has relatively few requirements for a signal source distance. Therefore, a signal source of the non-millimeter wave antenna 4 does not need to be integrated in the antenna module. Generally, the signal source of the non-millimeter wave antenna 4 may be disposed on a main board of an electronic device. The electronic device is the foregoing electronic device in which the antenna module is installed, such as a mobile phone, a tablet computer, or a computer.

Generally, the millimeter wave antenna has a small size, that is, the dipole antenna unit 2 has a relatively small size, but the non-millimeter wave antenna 4 has a relatively large size (especially the non-millimeter wave antenna 4 has a long length). Therefore, that the N dipole antenna units 2 are successively disposed at an interval along the length direction of the substrate 1 helps to not only form the millimeter wave antenna array, but also provide enough length space for the non-millimeter wave antenna 4. For example, four dipole antenna units 2 may be used to form a 1×4 millimeter wave antenna array. Correspondingly, the length direction of the non-millimeter wave antenna 4 may be the same as that of the substrate 1, so as to utilize the space of the substrate 1 rationally.

After the millimeter wave antenna array is formed, a phase of a phase shifter in the radio frequency integrated circuit 3 may be controlled, so that each of the dipole antenna units 2 may generate a plurality of beams in different directions, thereby forming beamforming (beamforming).

Alternatively, there may be one or more than one non-millimeter wave antennas 4. When there are more than one non-millimeter wave antennas 4, for example, when there are two non-millimeter wave antennas 4, the non-millimeter wave antennas 4 are successively arranged along a length direction of the substrate 1. In this way, on one hand, the antenna module may form MIMO (Multiple-Input Multiple-Output), improving the throughput of the antenna module and enhancing the wireless connection capability of the antenna module; on the other hand, an integration degree of the antenna module is further improved, saving overall space occupied by each antenna. For example, two non-millimeter wave antennas 4 may be placed along a length direction of the antenna module.

Alternatively, the antenna module further includes a power management integrated circuit 5. The power management integrated circuit 5 is disposed on the first dielectric layer 12, and the power management integrated circuit 5 provides power supply or power management for the radio frequency integrated circuit 3.

The PMIC (Power Management Integrated Circuits) 5 is configured to provide power supply or power management for the radio frequency integrated circuit 3. The power management integrated circuit 5 and the radio frequency integrated circuit 3 are both integrated in the substrate, which helps to improve an integration degree of the antenna module.

In this way, the millimeter wave antenna array, the radio frequency integrated circuit 3, and the power management integrated circuit 5 are integrated in the same antenna module, that is, an antenna structure of AiP (Antenna in package) is formed. Therefore, the antenna module provided according to some embodiments of the present disclosure may form an antenna structure of a millimeter wave antenna in package.

Alternatively, the antenna module further includes a connector 6. The connector 6 is connected to a feeding point of the non-millimeter wave antenna 4. Specifically, a feeder (or a feeding signal line) of the non-millimeter wave antenna 4 may be connected to a signal pin of the connector 6 through a transmission line (or signal line) buried in the second dielectric layer 13. The signal pin of the connector 6 is connected to a signal source on a main board of an electronic device through a transmission line. Specifically, the antenna module may be connected to the main board of the electronic device through the connector 6 using FPC made of an LCP (Liquid Crystal Polymer) or MPI (Modified Polyimide) material. The connector 6 may be a board-to-board connector (BTB connector).

The connector 6 not only has a signal pin configured to transmit signals for the non-millimeter wave antenna 4, but also has a grounding pin for grounding of the antenna module. The grounding pin of the connector 6 may be connected to the floor 11.

In addition, the connector 6 may further be provided with a pin connected to the power management integrated circuit 5, so that the connector 6 is connected to the power management integrated circuit 5. Therefore, electric energy of the electronic device may be transmitted to the power management integrated circuit 5, thereby implementing power supply to the radio frequency integrated circuit 3.

It can be seen from the above that by setting the connector 6 in the antenna module, functions such as signal transmission, grounding, and power transmission may be implemented, which helps to improve an integration degree of the antenna module.

In some embodiments of the present disclosure, the connector 6 may be disposed at any suitable position of the antenna module. Considering that the connector 6 is configured to implement grounding of the radio frequency integrated circuit 3, the non-millimeter wave antenna 4, the power management integrated circuit 5, and other components, the connector 6 may be appropriately disposed close to the floor 11 to facilitate connection between the connector 6 and the floor 11. In some embodiments of the present disclosure, at least the following two alternative implementations are used to provide convenient grounding conditions for disposing of the connector 6.

First, the length of the second dielectric layer 13 is less than that of the floor 11, and the connector 6 is disposed on the floor 11. Specifically, the connector 6 is disposed at a part of the floor 11 extending out of the second dielectric layer 13. Here, the length of the second dielectric layer 13 needs to meet length space required by the millimeter wave antenna array, while lengths of the floor 11 and the first dielectric layer 12 may be longer than that required by the millimeter wave antenna array. Further, the length of the first dielectric layer 12 may be equal to that of the floor 11.

Second, the length of the first dielectric layer 12 is less than that of the floor 11, and the connector 6 is disposed on the floor 11. Specifically, the connector 6 is disposed at a part of the floor 11 extending out of the first dielectric layer 12. Here, the length of the first dielectric layer 12 needs to meet length space requirements for the millimeter wave antenna array, while lengths of the floor 11 and the second dielectric layer 13 may be longer than that required by the millimeter wave antenna array. Further, the length of the second dielectric layer 13 may be equal to that of the floor 11.

In addition, considering that the non-millimeter wave antenna 4 is disposed on the second dielectric layer 13, and the non-millimeter-wave antenna 4 has a relatively greater length, especially when a plurality of non-millimeter wave antennas 4 is disposed in the antenna module, the foregoing second implementation may be used in some embodiments of the present disclosure, to provide more installation space for the non-millimeter-wave antenna 4.

It should be noted that, except for the grounding pin of the connector 6, which is connected to the floor 11, other pins of the connector 6 is not in contact with the floor 11. Specifically, by cutting a hole or groove in the floor 11, a transmission line of the other pins of the connector 6 may be connected to a feeding point of an antenna or a pin of the integrated circuit through the hole or groove in the floor 11.

Through the foregoing implementations, after a millimeter wave dipole antenna array is integrated with the non-millimeter wave antenna, an integration degree of the antenna module is improved, effectively reducing overall space occupied by antennas. The antenna module according to some embodiments of the present disclosure may be applied to design of the millimeter wave antenna of the electronic device.

A related scheme of the dipole antenna units forming the millimeter wave antenna array will be described in detail below.

Figure 10:
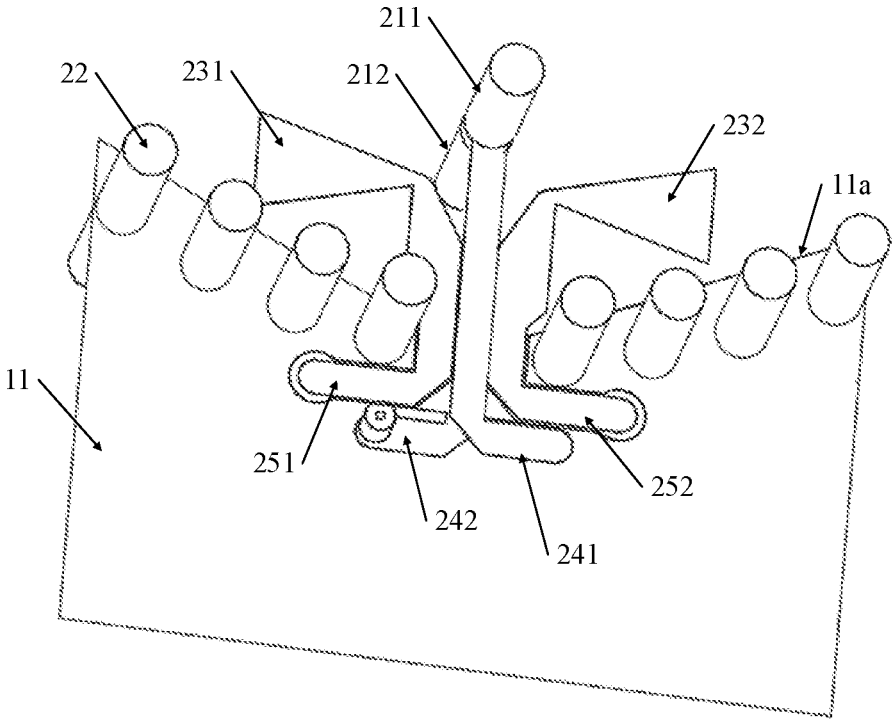
FIG. 10 is a three-dimensional structural diagram of a dipole antenna unit according to some embodiments of the present disclosure.
Figure 11:
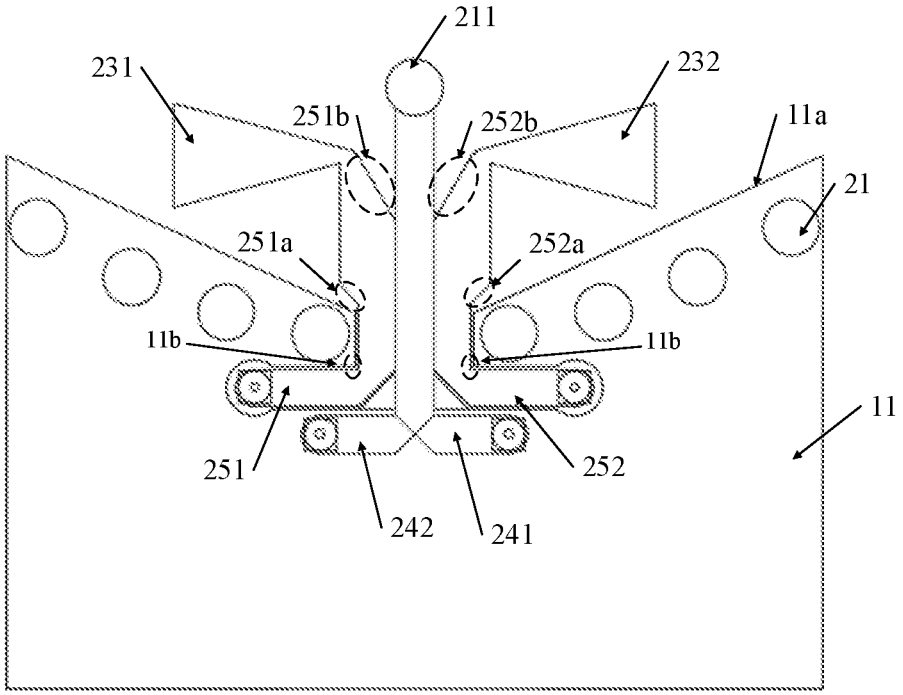
FIG. 11 is a top view of the dipole antenna unit of FIG. 10.

Alternatively, as shown in FIG. 10 and FIG. 11, a dipole antenna unit 2 includes:

a vertically polarized dipole antenna 21, including a first antenna branch 211 and a second antenna branch 212, where the first antenna branch 211 and the second antenna branch 212 are disposed in a substrate 1 at an interval. Either of the first antenna branch 211 or the second antenna branch 212 and the floor 11 are disposed at an interval, and the first antenna branch 211 and the second antenna branch 212 are connected to a radio frequency integrated circuit 3 through a first feeding structure 24; and a reflector, including several reflection pillars 22, where the several reflection pillars 22 are disposed in the substrate 1 at an interval along a parabola.

The first antenna branch 211 and the second antenna branch 212 are both located on the side where a focal point of the parabola is located.

The first antenna branch 211 and the second antenna branch 212 are disposed in the substrate 1 at an interval. It can be understood that the first antenna branch 211 is not in contact with the second antenna branch 212, and there is a gap between them. Either of the first antenna branch 211 or the second antenna branch 212 and the floor 11 are disposed at an interval. It can be understood that neither the first antenna branch 211 nor the second antenna branch 212 is in contact with the floor 11, there is a gap between the first antenna branch 211 and the floor 11, and there is also a gap between the second antenna branch 212 and the floor 11.

It should be noted that, in a width direction of the substrate 1, widths of a first dielectric layer 12 and a second dielectric layer 13 are both larger than that of the floor 11, and either of the first antenna branch 211 or the second antenna branch 212 and the floor 11 are disposed at an interval. It can be understood that the first antenna branch 211 and the second antenna branch 212 are disposed at an interval at a non-floor region of the substrate 1, that is, a clearance area of the substrate 1. The first feeding structure 24 extends from the clearance area of the substrate to a region where the floor 11 of the substrate is located.

The first antenna branch 211 and the second antenna branch 212 of the vertically polarized dipole antenna 21 are both vertically disposed in the substrate 1. Specifically, the first antenna branch 211 and the second antenna branch 212 may be disposed in the substrate 1 in a direction perpendicular to the substrate 1, or in another direction slightly deviating from the direction perpendicular to the substrate 1. A central axis of the first antenna branch 211 and a central axis of the second antenna branch 22 may completely coincide with each other, or be slightly staggered with each other by a certain angle, or slightly deviate from each other by a certain distance. A length of the first antenna branch 211 may be equal to or approximately equal to a length of the second antenna branch 212, and the lengths of the first antenna branch 211 and the second antenna branch 212 are approximately a quarter of a dielectric wavelength.

The foregoing reflector is used as a reflector of the vertically polarized dipole antenna 21. A disposing direction of each reflection pillar 22 in the substrate 1 needs to match the disposing directions of the first antenna branch 211 and the second antenna branch 212. In this way, each reflection pillar 22 also needs to be vertically disposed in the substrate 1. Specifically, each reflection pillar 22 may be disposed in the substrate 1 in a direction perpendicular to the substrate 1, or in another direction slightly deviating from the direction perpendicular to the substrate 1.

In a mainstream millimeter wave antenna in package, an antenna layer is generally a patch antenna. The patch antenna generally produces broadside radiation and seldom produces end-fire radiation. In some embodiments of the present disclosure, the vertically polarized dipole antenna 21 and the reflector that is arranged along the parabola are disposed in the substrate 1, and the vertically polarized dipole antenna 21 is disposed on the side where a focal point of the parabola is located, so that most beams of the vertically polarized dipole antenna 21 radiate towards a front end, and radiation towards a back end is reduced. Therefore, the dipole antenna unit 2 may generate end-fire radiation, improving end-fire radiation performance of the dipole antenna unit 2.

It should be noted that each antenna branch and each reflection pillar 22 of the vertically polarized dipole antenna 21 need to occupy certain height space (or thickness space), and in order to improve bandwidth performance of the non-millimeter wave antenna 4, the non-millimeter wave antenna 4 also needs to occupy certain height space. Therefore, the vertically polarized dipole antenna 21 is used as the dipole antenna unit 2, so that a space utilization rate of the antenna module as a whole is improved.

Alternatively, the central axis of the first antenna branch 211 and the central axis of the second antenna branch 212 are both through the focal point of the parabola. In this way, a gain of the vertically polarized dipole antenna 21 and a front-to-back ratio of a radiation pattern of the vertically polarized dipole antenna can be increased.

When the substrate 1 includes a floor 11, a first dielectric layer 12, and a second dielectric layer 13, the first antenna branch 211 may be disposed in the first dielectric layer 12, the second antenna branch 212 may be disposed in the second dielectric layer 13, and the reflection pillar 22 may successively penetrate the first dielectric layer 12, the floor 11, and the second dielectric layer 13.

Since the first antenna branch 211 and the second antenna branch 212 need to be separated by a certain distance, both the first dielectric layer 12 and the second dielectric layer 13 may be formed by stacking at least two dielectric plates.

For example, the first dielectric layer 12 includes two dielectric plates, and the second dielectric layer 13 includes two dielectric plates, that is, the substrate 1 includes four dielectric plates. The first antenna branch 211 is disposed in a first dielectric plate a and penetrates the first dielectric plate a. The floor 11 is disposed on a surface of a third dielectric plate c close to a second dielectric plate b. The second antenna branch 212 is disposed in a fourth dielectric plate d and penetrates the fourth dielectric plate d. The reflection pillar 22 penetrates four dielectric plates, that is, the reflection pillar 22 penetrates the first dielectric plate a to the fourth dielectric plate d.

In this way, a corresponding dielectric plate and the floor 11 may be processed separately to form the first antenna branch 211, the second antenna branch 212, and the reflection pillar 22. On the one hand, a manufacturing process of an antenna unit can be simplified; on the other hand, lengths of the first antenna branch 211, the second antenna branch 212, and the reflection pillar 22, as well as a spacing between the first antenna branch 211 and the second antenna branch 212 can be controlled easily. In particular, the lengths of the first antenna branch 211 and the second antenna branch 212 can be more accurately controlled, so that the lengths of the first antenna branch 211 and the second antenna branch 212 are approximately a quarter of a dielectric wavelength, thereby improving the performance of the antenna unit. In addition, by controlling the thickness of each dielectric plate, the vertically polarized dipole antenna 21 may be more symmetric with a simple process, which may be implemented easily.

Alternatively, the first antenna branch 211 and the second antenna branch 212 are respectively formed by metal pillars penetrating corresponding dielectric plates, and the reflection pillar 22 is formed by several metal pillars penetrating N dielectric plates.

Specifically, dielectric plates corresponding to the first antenna branch 211 and the second antenna branch 212 are both provided with through holes (not shown in the figure) vertically penetrating the dielectric plates, and the first antenna branch 211 and the second antenna branch 212 are formed by metal pillars with which the through holes are filled. Several through holes perpendicularly penetrating all dielectric plates are formed in the dielectric plates along a parabola, and all the reflection pillars 22 of the reflector are formed by metal pillars with which the several through holes are filled.

The first antenna branch 211, the second antenna branch 212, and the reflection pillars 22 are formed by punching holes in the dielectric plates and disposing metal pillars in the holes. Therefore, the process is simple and mature, and nearly no additional production cost is added.

The antenna unit in some embodiments of the present disclosure may be provided with only the vertically polarized dipole antenna, thereby being used as a single-polarized dipole antenna. The antenna unit in some embodiments of the present disclosure may further be set to a dual-polarized dipole antenna.

Alternatively, as shown in FIG. 10 and FIG. 11, the dipole antenna unit 2 further includes:

a horizontally polarized dipole antenna 23. The horizontally polarized dipole antenna 23 includes a third antenna branch 231 and a fourth antenna branch 232. The third antenna branch 231 and the fourth antenna branch 232 are disposed in the substrate 1 at an interval, and both the third antenna branch 231 and the fourth antenna branch 232 are located in a plane where the floor 11 is located. The floor 11 and either of the third antenna branch 231 or the fourth antenna branch 232 are disposed at an interval. The third antenna branch 231 and the fourth antenna branch 232 are connected to the radio frequency integrated circuit 3 through a second feeding structure 25.

The third antenna branch 231 and the fourth antenna branch 232 are both located on the side where a focal point of the parabola is located.

The first antenna branch 211 and the second antenna branch 212 are respectively located on two sides of a plane where the third antenna branch 231 and the fourth antenna branch 232 are located, and the third antenna branch 231 and the fourth antenna branch 232 are respectively located on two sides of the first antenna branch 211 and the second antenna branch 212.

The third antenna branch 231 and the fourth antenna branch 232 of the horizontally polarized dipole antenna 23 are both transversely (or horizontally) disposed in the substrate 1. Specifically, the third antenna branch 231 and the fourth antenna branch 232 may be disposed in the substrate 1 in a direction parallel to the substrate 1, or in another direction slightly deviating from the direction parallel to the substrate 1. A central axis of the third antenna branch 231 and a central axis of the fourth antenna branch 232 may completely coincide with each other, or be slightly staggered with each other by a certain angle, or slightly deviate from each other by a certain distance. The length of the third antenna branch 231 and the length of the fourth antenna branch 232 may be equal or approximately equal. The lengths of the third antenna branch 231 and the fourth antenna branch 232 are approximately a quarter of a wavelength in a medium.

Both the third antenna branch 231 and the fourth antenna branch 232 are located on a plane on which the floor 11 is located. In this way, the floor 11 may be used as a reflector of the horizontally polarized dipole antenna 23, and can reflect a beam of the horizontally polarized dipole antenna 23. Therefore, the horizontally polarized dipole antenna 23 can generate end-fire radiation, further improving end-fire radiation performance of the dipole antenna unit 2.

The floor 11 and either of the third antenna branch 231 or the fourth antenna branch 232 are disposed at an interval. It can be understood that the third antenna branch 231 and the fourth antenna branch 232 are disposed in a non-floor area of the substrate 1, that is, a clearance area of the substrate 1, and the second feeding structure 25 extends from the clearance area of the substrate to a region where the floor 11 of the substrate is located.

In some embodiments of the present disclosure, the vertically polarized dipole antenna 21 and the horizontally polarized dipole antenna 23 are combined, to implement design of a dual-polarized dipole antenna. In one aspect, a multiple-input multiple-output function may be implemented, to improve a data transmission rate. In another aspect, a wireless connection capability of the antenna can be increased, a probability of communication disconnection is reduced, and a communication effect and user experience are improved.

Alternatively, the first antenna branch 211 is symmetrical to the second antenna branch 212 relative to a plane in which the third antenna branch 231 and the fourth antenna branch 232 are disposed.

The third antenna branch 231 is symmetrical to the fourth antenna branch 232 relative to the first antenna branch 211 and the second antenna branch 212.

It can be learned from the entire structure that, the two antenna branches of the horizontally polarized dipole antenna 23 are inserted into a middle position between the two antenna branches of the vertically polarized dipole antenna 21, and the two antenna branches of the vertically polarized dipole antenna 21 are inserted into a middle position between the two antenna branches of the horizontally polarized dipole antenna 23. Therefore, the entire structure is kept strictly symmetrical in a horizontal direction and a vertical direction, which can prevent angle offset of the radiation patterns in a primary radiation direction.

Alternatively, the first feeding structure 24 includes:

a first feeder 241, where the first antenna branch 211 is connected to the radio frequency integrated circuit 3 through the first feeder 241; and a second feeder 242, where the second antenna branch 212 is connected to the radio frequency integrated circuit 3 through the second feeder 242.

The second feeding structure 25 includes:

a third feeder 251, where the third antenna branch 231 is connected to the radio frequency integrated circuit 3 through the third feeder 251; and a fourth feeder 252, where the fourth antenna branch 232 is connected to the radio frequency integrated circuit 3 through the fourth feeder 252.

The foregoing feeding structures of the vertically polarized dipole antenna 21 and the horizontally polarized dipole antenna 23, namely, the first feeding structure 24 and the second feeding structure 25 both adopt double-ended feeding. Signal sources connected to two feeders of each feeding structure have equal amplitudes and a 180-degree phase difference. In other words, the vertically polarized dipole antenna 21 and the horizontally polarized dipole antenna 23 both adopt differential feeding. The differential feeding is used, so that a common mode rejection capability and an anti-interference capability of the antenna can be improved. In addition, end-to-end isolation of differentiation and polarization purity can be improved. In addition, radiation power of the antenna may be higher than that of an antenna with a single-ended feeding structure.

It should be noted that, for an antenna unit including only the vertically polarized dipole antenna 21, the first feeding structure 24 may also be the foregoing double-ended feeding structure. This is easy to understand. To avoid repetition, details are not described herein again.

Since the third antenna branch 231 and the fourth antenna branch 232 are both located in a plane where the floor 11 is located, when the third feeder 251 and the fourth feeder 252 are connected to the radio frequency integrated circuit 3, they need to be extended to the plane where the floor 11 is located, and then extended downward from the plane where the floor 11 is located to the radio frequency integrated circuit 3. Therefore, on a path through which the third feeder 251 and the fourth feeder 252 pass, a slot or hole needs to be cut in the floor 11, and there is a gap between either of the third feeder 251 or the fourth feeder 252 and the floor 11.

Alternatively, the two antenna branches of the vertically polarized dipole antenna 21 both adopt coaxial-line differential feeding, and the two antenna branches of the horizontally polarized dipole antenna 23 both adopt coaxial-line differential feeding.

The third feeder 251 and the fourth feeder 252 are mainly formed by connecting coaxial lines to a coplanar waveguide (CoPlanar Waveguide, CPW for short) and then respectively connecting the coaxial lines to the third antenna branch 231 and the fourth antenna branch 232.

For a structure that a first dielectric layer 12 includes two dielectric plates and a second dielectric layer 13 includes two dielectric plates, that is, a substrate 1 includes four dielectric plates, the first antenna branch 211 is disposed in a first dielectric plate a and penetrates the first dielectric plate a. A first feeder 241 is disposed on a surface of a second dielectric plate b close to the first dielectric board a. A third antenna branch 231, a fourth antenna branch 232, a third feeder 251, a fourth feeder 252, and a floor 11 are all disposed on a surface of a third dielectric plate c close to the second dielectric plate b. A second feeder 242 is disposed on a surface of a fourth dielectric plate d close to the third dielectric plate c. The second antenna branch 212 is disposed in the fourth dielectric plate d and penetrates the fourth dielectric plate d. A reflection pillar 22 penetrates four dielectric plates, that is, the reflection pillar 22 penetrates the first dielectric plate a to the fourth dielectric plate d.

Alternatively, a side edge of the floor 11 facing the third antenna branch 231 and the fourth antenna branch 232 is a concave side edge.

In some embodiments of the present disclosure, a side edge of the floor 11 close to the horizontally polarized dipole antenna 23 is set to a concave side edge. In this way, the side edge of the floor 11 close to the horizontally polarized dipole antenna 23 may form a concave reflection surface. Under the action of the concave reflection surface, most beams of the horizontally polarized dipole antenna 23 may be radiated toward a front end, thereby improving a reflection effect of the floor 11 for an antenna signal, enhancing beam transmission performance of the horizontally polarized dipole antenna 23, and enabling the horizontally polarized dipole antenna 23 to satisfy a radiation requirement of high directivity.

In addition, because the floor 11 has a specific thickness, a concave side edge 11*a* of the floor 11 may form a concave reflection surface, so that a structure of the antenna module is more compact, and a size of a dielectric substrate at a front end of the horizontally polarized dipole antenna 23 is relatively small. In addition, the concave reflection surface of the floor 11 is similar to a cavity structure. In this cavity structure, the horizontally polarized dipole antenna 23 may generate resonance, so that another frequency point may be generated.

Alternatively, a shape of the concave side edge 11*a* of the floor 11 is an arc, such as a parabolic shape, a hyperbolic shape, an elliptical arc, or a circular arc.

Figure 12:
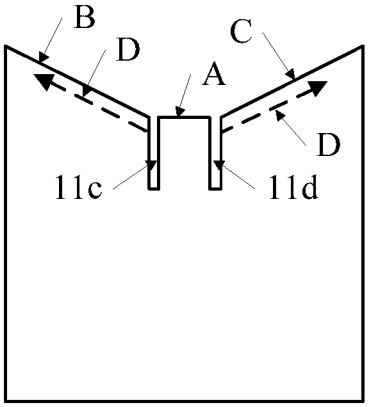
FIG. 12 is a schematic structural diagram of a floor according to some embodiments of the present disclosure.
Figure 13:
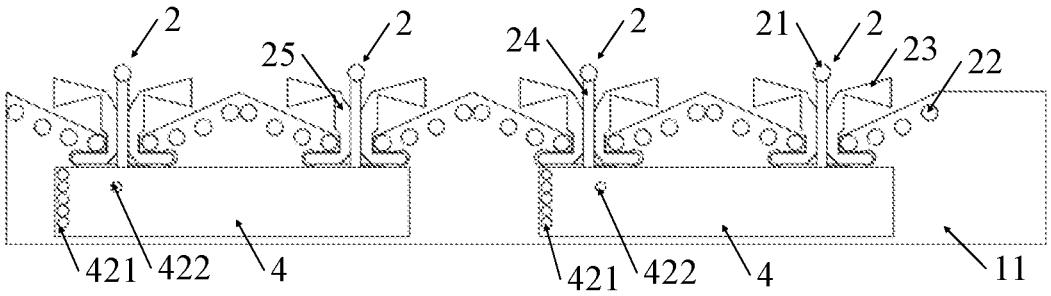
FIG. 13 to FIG. 15 are schematic structural diagrams of an antenna module using the dipole antenna unit of FIG. 10.
Figure 14:
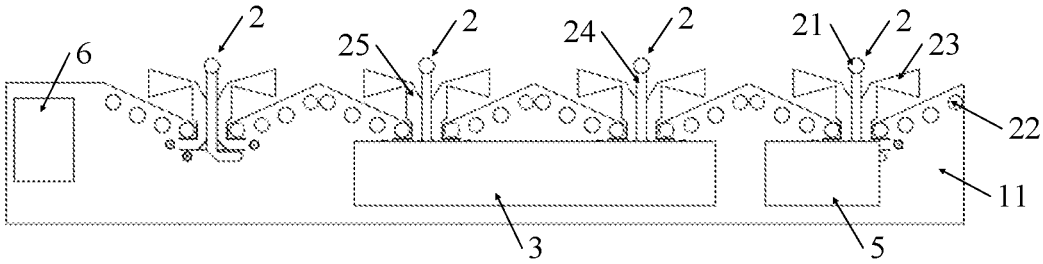

As shown in FIG. 12, the concave side edge 11*a* of the floor 11 includes a first straight segment A located in a middle region and a second straight segment B and a third straight segment C that are located in two side regions. An included angle between the second straight segment B and the first straight segment A is an obtuse angle, and an included angle between the third straight segment C and the first straight segment A is an obtuse angle. Further, the second straight segment B and the third straight segment C are symmetrically disposed relative to the first straight segment A.

Alternatively, as shown in FIG. 12, the floor 11 is provided with a first feeder slot 11*c* and a second feeder slot 11*d* that are connected to the concave side edge 11*a*.

The third feeder 251 extends through the first feeder slot 11*c* and is connected to the radio frequency integrated circuit 3, and the fourth feeder 252 extends through the second feeder slot 11*d* and is connected to the radio frequency integrated circuit 3. There is a gap 11*b* between either of the third feeder 251 or the fourth feeder 252 and the floor 11.

The third feeder 251 and the fourth feeder 252 serve as transmission lines of the coplanar waveguide, and the gap 11*b* between either of the third feeder 251 or the fourth feeder 252 and the floor 11 is used to adjust impedance of the transmission line of the coplanar waveguide. For example, impedance of the transmission line of the entire coplanar waveguide is adjusted to approximately 50 ohms. By adjusting the impedance of the transmission line of the coplanar waveguide, it helps to reduce signal reflection, to feed more energy to the antenna for feeding. A size of the gap 11*b* may be determined by factors such as a dielectric layer thickness of the substrate 1, a dielectric constant of the dielectric layer, and a signal line width of the transmission line of the coplanar waveguide (that is, widths of the third feeder 251 and the fourth feeder 252).

Figure 2:
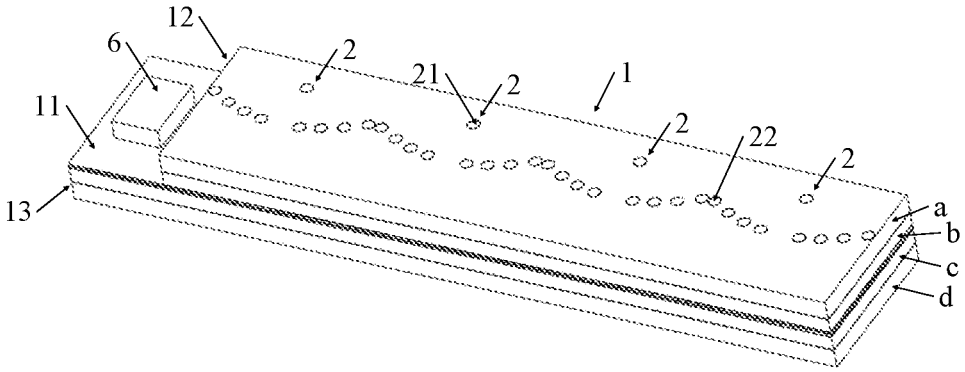
FIG. 2 is a three-dimensional structural diagram of an antenna module with its front side upward, according to some embodiments of the present disclosure.
Figure 3:
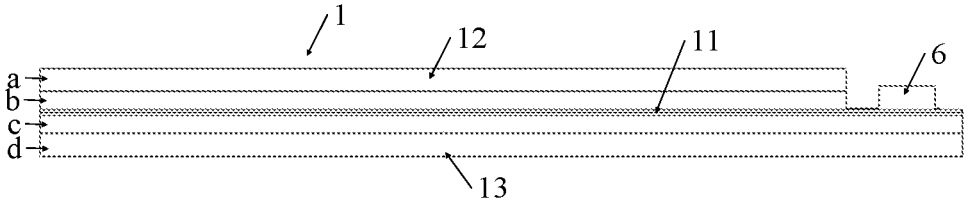
FIG. 3 is a side view of an antenna module according to some embodiments of the present disclosure.
Figure 4:
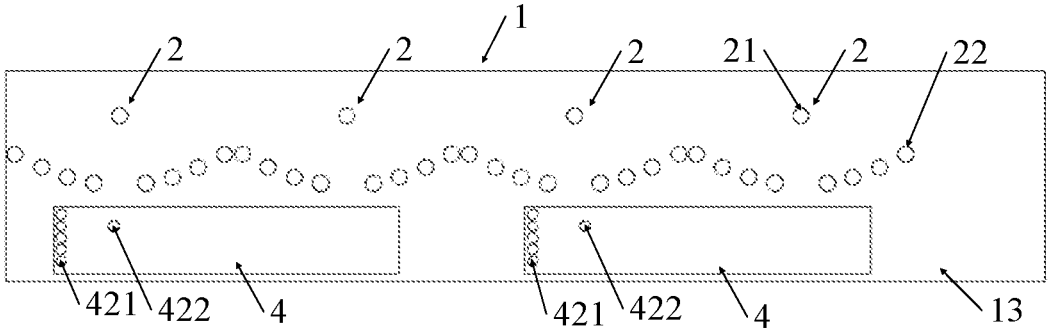
FIG. 4 is a bottom view of an antenna module according to some embodiments of the present disclosure.
Figure 5:
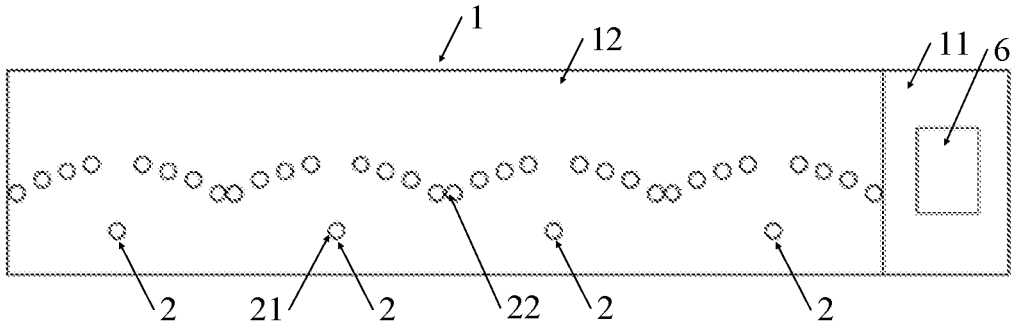
FIG. 5 is a top view of an antenna module according to some embodiments of the present disclosure.
Figure 6:
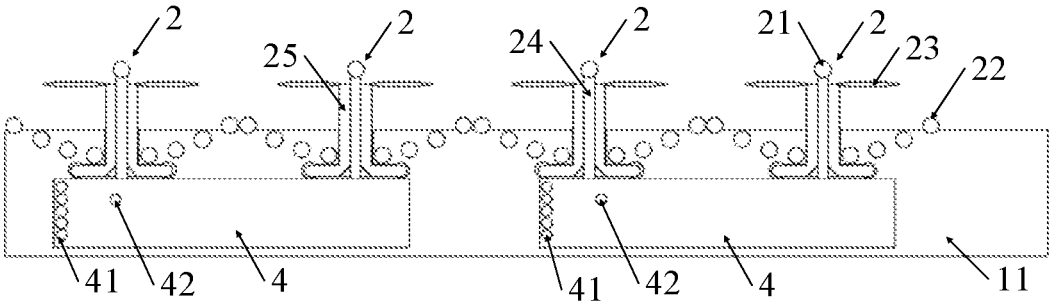
FIG. 6 is a first schematic structural diagram of an antenna module with a dielectric layer removed, according to some embodiments of the present disclosure.
Figure 7:
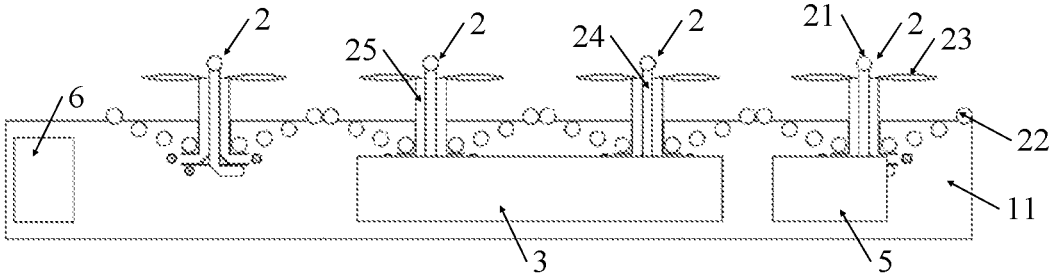
FIG. 7 is a second schematic structural diagram of an antenna module with a dielectric layer removed, according to some embodiments of the present disclosure.

However, in some embodiments of the present disclosure, for example, the concave side edge 11*a* of the floor 11 includes a first straight segment A located in a middle region and a second straight segment B and a third straight segment C that are located in two side regions. Because both the second straight segment B and the third straight segment C extend gradually from the first straight segment A to a side on which the horizontally polarized dipole antenna 23 is located, and the second straight segment B and the third straight segment C are not used as impedance reference ground of the transmission line of the coplanar waveguide, a part of energy of the third feeder 251 and the fourth feeder 252 can be separately coupled to the second straight segment B and the third straight segment C by the gap 11*b*. In this way, the second straight segment B and the third straight segment C separately form a current path D, as shown in FIG. 2, so that it is more helpful for the horizontally polarized dipole antenna 23 to generate resonance, so that another frequency point may be generated.

Alternatively, the third feeder 251 includes a first segment located in the first feeder slot 11*c* and a second segment located between the third antenna branch 231 and the floor 11. The width of the first segment is smaller than that of the second segment, and a position of the second segment adjacent to the first segment is provided with a first corner cut 251*a* (a position indicated by a dashed ellipse in FIG. 11).

The fourth feeder 252 includes a third segment located in the second feeder slot 11*d* and a fourth segment located between the fourth antenna branch 232 and the floor 11. The width of the third segment is smaller than that of the fourth segment, and a position of the fourth segment adjacent to the third segment is provided with a second corner cut 252*a* (a position indicated by a dashed ellipse in FIG. 11).

By cutting the foregoing parts of the third feeder 251 and the fourth feeder 252, impedance of the third feeder 251 and the fourth feeder 252 changes more gently, which helps to expand a bandwidth of the horizontally polarized dipole antenna 23.

Alternatively, a position of the second segment adjacent to the third antenna branch 231 is provided with a third corner cut 251*b* (a position shown by a dashed ellipse in FIG. 11).

A position of the fourth segment adjacent to the fourth antenna branch 232 is provided with a fourth corner cut 252*b* (a position indicated by a dashed ellipse in FIG. 11).

By cutting the foregoing parts of the third feeder 251 and the fourth feeder 252, impedance of the third feeder 251 and the fourth feeder 252 changes more gently, which helps to further expand the bandwidth of the horizontally polarized dipole antenna 23.

Alternatively, a shape of the third antenna branch 231 is an isosceles triangle, and an apex angle of the third antenna branch 231 is connected to the third feeder 251.

A shape of the fourth antenna branch 232 is an isosceles triangle, and an apex angle of the fourth antenna branch 232 is connected to the fourth feeder 252.

Since the third antenna branch 231 and the fourth antenna branch 232 adopt gradually varied structures of isosceles triangles, impedance of the third antenna branch 231 and the fourth antenna branch 232 will not suddenly change, which helps to expand the bandwidth of the horizontally polarized dipole antenna 23.

In addition, the third antenna branch 231 and the fourth antenna branch 232 may be rectangular or oval. Because shapes of ovals change gently when the third antenna branch and the fourth antenna branch are oval, impedance changes of the antenna are relatively gentle, which helps to expand the bandwidth of the horizontally polarized dipole antenna 23.

Figure 16:
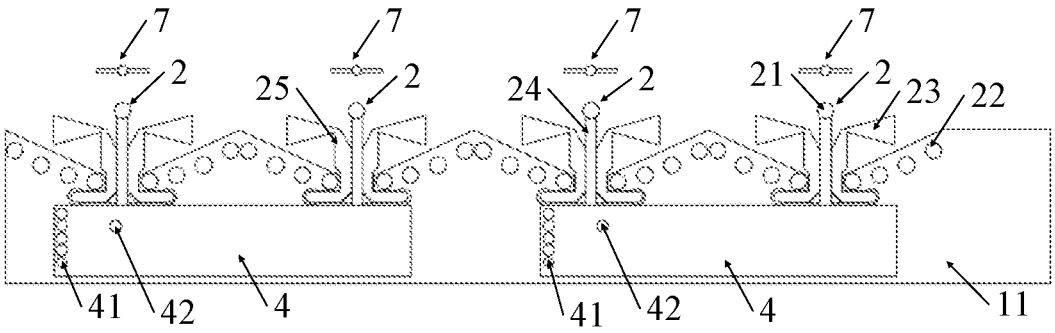
FIG. 16 is a schematic structural diagram of an antenna module provided with a director, according to some embodiments of the present disclosure.
Figure 17:
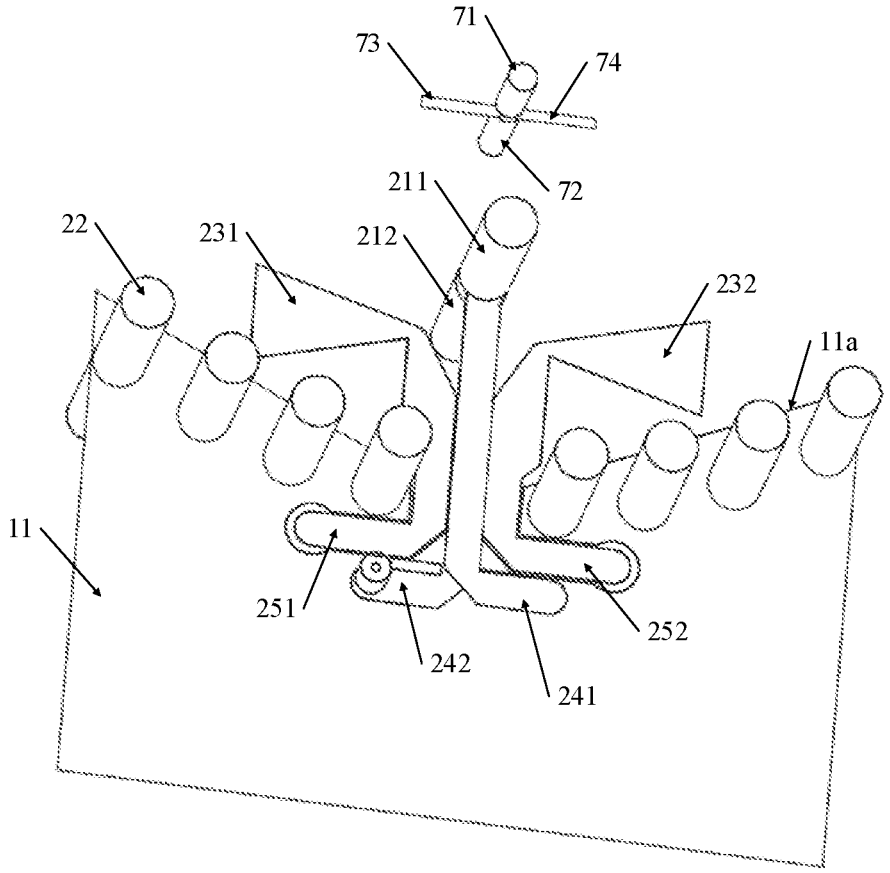
FIG. 17 is a three-dimensional structural diagram of a dipole antenna unit provided with a director, according to some embodiments of the present disclosure.

Alternatively, as shown in FIG. 16 and FIG. 17, the antenna module further includes N directors 7. The N directors 7 are disposed in a substrate 1. Among N dipole antenna units 2, the N dipole antenna units 2 are disposed in one-to-one correspondence with the N directors 7.

Specifically, one director 7 is disposed in front of each dipole antenna unit 2. By disposing one director 7 in front of each dipole antenna unit 2, directivity of a millimeter wave antenna may be further improved, thereby improving communication performance of the antenna module. It should be noted that the front of the dipole antenna unit 2 refers to a direction for beam emission of the dipole antenna unit 2. Further, to improve directing performance of the director 7, the director 7 may be disposed right in front of the dipole antenna unit 2.

Alternatively, the director 7 includes a first vertical directing branch 71, a second vertical directing branch 72, a first horizontal directing branch 73, and a second horizontal directing branch 74. The first vertical directing branch 71, the second vertical directing branch 72, the first horizontal directing branch 73, and the second horizontal directing branch 74 are disposed at intervals.

The first vertical directing branch 71 may be disposed on a first dielectric layer 12 of the substrate 1, and the second vertical directing branch 72 may be disposed on a second dielectric layer 13 of the substrate 1. The first horizontal directing branch 73 and the second horizontal directing branch 74 may be located on a plane where a floor 11 is located.

Further, the first vertical directing branch 71 and the second vertical directing branch 72 may be symmetrically disposed relative to the plane where the floor 11 is located, and the first horizontal directing branch 73 and the second horizontal directing branch 74 may be symmetrically disposed relatively to the first vertical directing branch 71 and the second vertical directing branch 72. As a whole, each branch of the director 7 is disposed in a manner corresponding to a manner in which the dipole antenna unit 2 is disposed, so that the performance of the director 7 may be in the optimal state.

Figure 18:
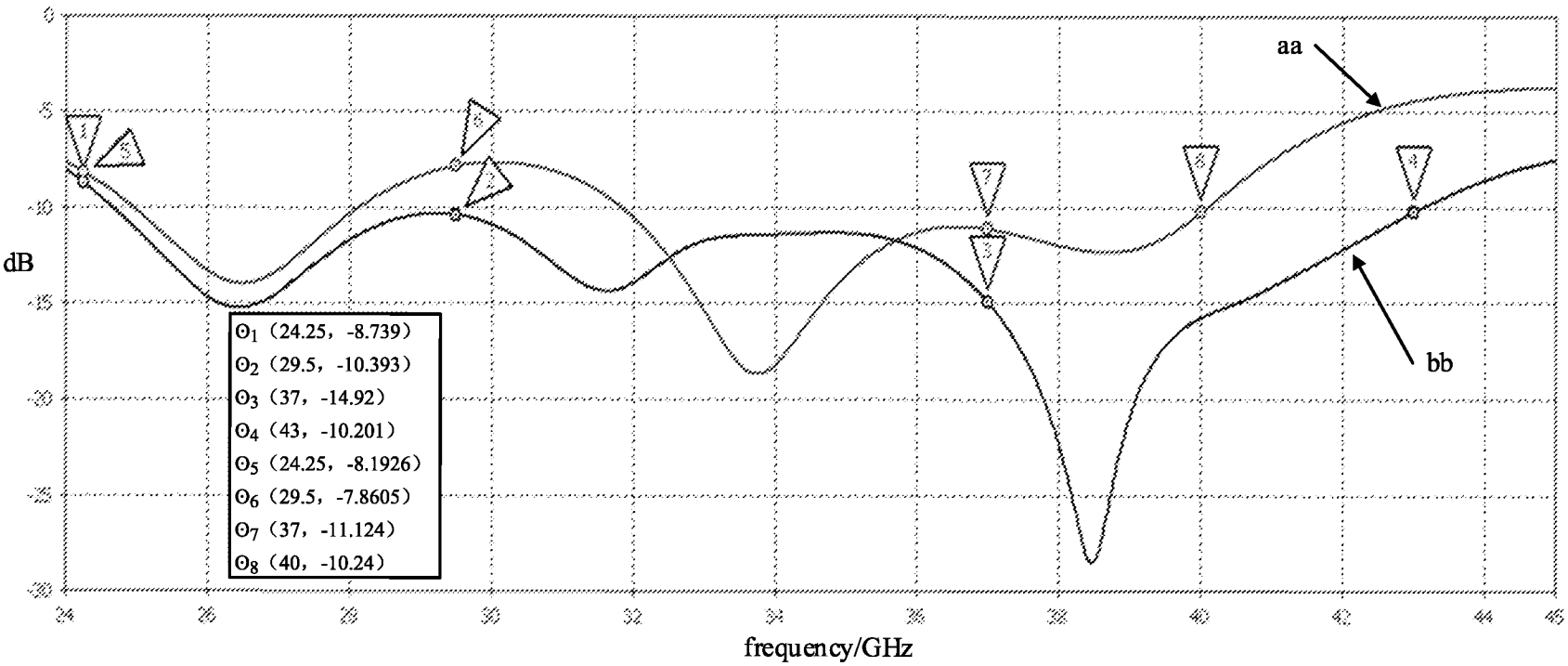
FIG. 18 is a reflection coefficient diagram of a simulation result of a dipole antenna unit in an antenna module according to some embodiments of the present disclosure.

FIG. 18 is a reflection coefficient diagram of a simulated dipole antenna unit 2, in which curve aa is a reflection coefficient curve of a vertically polarized dipole antenna 21 and curve bb is a reflection coefficient curve of a horizontally polarized dipole antenna 23. −10 dB S parameters of the horizontally polarized dipole antenna 23 and the vertically polarized dipole antenna 21 may cover 24.25 GHz-29.5 GHz and 37 GHz-40 GHz, basically covering a global mainstream 5G millimeter wave frequency range including n257, n258, n260, and n261 defined by 3GPP.

In addition, an isolator (not shown in the figure) may be disposed between adjacent dipole antenna units 2 to reduce mutual coupling between the adjacent dipole antenna units 2 and ensure the working performance of a millimeter wave antenna array. Specifically, the isolator includes several isolation pillars that are disposed at an interval. The isolation pillars may be perpendicular to a substrate 1 and penetrate the substrate 1.

The antenna module in some embodiments of the present disclosure may be applied to a wireless metropolitan area network (Wireless Metropolitan Area Network, WMAN), a wireless wide area network (Wireless Wide Area Network, WWAN), a wireless local area network (Wireless Local Area Network, WLAN), a wireless personal area network (Wireless Personal Area Network, WPAN), multiple-input multiple-output (MIMO), radio frequency identification (Radio Frequency Identification, RFID), and other wireless communication scenarios.

Some embodiments of the present disclosure further relate to an electronic device, including the antenna module according to any one of some embodiments of the present disclosure. A connector 6 of the foregoing antenna module is connected to a main board of the electronic device.

For specific implementations of the antenna module in the electronic device, the foregoing descriptions are used as a reference, and a same technical effect can be achieved. To avoid repetition, details are not described herein again.

The foregoing electronic device may be a computer (Computer), a mobile phone, a tablet personal computer (Tablet Personal Computer), a laptop computer (Laptop Computer), a personal digital assistant (personal digital assistant, PDA), a mobile internet device (Mobile Internet Device, MID), a wearable device (Wearable Device), an e-book reader, a navigator, a digital camera, or the like.

The foregoing descriptions are merely specific implementations of the present disclosure, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

The invention claimed is:

1. An antenna module, comprising:

a substrate, comprising a floor, a first dielectric layer, and a second dielectric layer, wherein the first dielectric layer and the second dielectric layer are located on two sides of the floor, respectively;

a millimeter wave antenna array, comprising N dipole antenna units, wherein the N dipole antenna units are successively disposed at an interval along the substrate, and N is an integer greater than 1;

a radio frequency integrated circuit, wherein the radio frequency integrated circuit is disposed on the first dielectric layer and is connected to feeding structures of the N dipole antenna units; and a non-millimeter wave antenna, wherein the non-millimeter wave antenna is disposed on the second dielectric layer.

2. The antenna module according to claim 1, wherein the non-millimeter wave antenna is flush with an outer surface of the second dielectric layer.

3. The antenna module according to claim 1, wherein a type of the non-millimeter wave antenna is a patch antenna, a planar inverted-F antenna, or a loop antenna.

4. The antenna module according to claim 1, wherein the antenna module further comprises a power management integrated circuit that is disposed on the first dielectric layer.

5. The antenna module according to claim 1, further comprising a connector, wherein the connector is connected to the non-millimeter wave antenna and the radio frequency integrated circuit, respectively.

6. The antenna module according to claim 5, wherein a length of the first dielectric layer is less than that of the floor, and the connector is disposed on the floor.

7. The antenna module according to claim 1, wherein the dipole antenna unit comprises:

a vertically polarized dipole antenna, comprising a first antenna branch and a second antenna branch, wherein the first antenna branch and the second antenna branch are disposed in the substrate at an interval, either of the first antenna branch or the second antenna branch and the floor are disposed at an interval, and the first antenna branch and the second antenna branch are connected to the radio frequency integrated circuit through a first feeding structure; and a reflector, wherein the reflector comprises several reflection pillars that are disposed in the substrate at an interval along a parabola, wherein the first antenna branch and the second antenna branch are both disposed on a side where a focal point of the parabola is located.

8. The antenna module according to claim 7, wherein the dipole antenna unit further comprises:

a horizontally polarized dipole antenna, comprising a third antenna branch and a fourth antenna branch, wherein the third antenna branch and the fourth antenna branch are disposed in the substrate at an interval, the third antenna branch and the fourth antenna branch are both located in a plane where the floor is located, either of the third antenna branch or the fourth antenna branch and the floor are disposed at an interval, and the third antenna branch and the fourth antenna branch are connected to the radio frequency integrated circuit through a second feeding structure, wherein the third antenna branch and the fourth antenna branch are both located on a side where the focal point of the parabola is located; and the first antenna branch and the second antenna branch are respectively located on two sides of a plane where the third antenna branch and the fourth antenna branch are located, and the third antenna branch and the fourth antenna branch are respectively located on two sides of the first antenna branch and the second antenna branch.

9. The antenna module according to claim 8, wherein the first feeding structure comprises:

a first feeder, wherein the first antenna branch is connected to the radio frequency integrated circuit through the first feeder; and a second feeder, wherein the second antenna branch is connected to a pin of the radio frequency integrated circuit through the second feeder; and the second feeding structure comprises:

a third feeder, wherein the third antenna branch is connected to a pin of the radio frequency integrated circuit through the third feeder; and a fourth feeder, wherein the fourth antenna branch is connected to a pin of the radio frequency integrated circuit through the fourth feeder.

10. The antenna module according to claim 9, wherein a side edge of the floor facing the third antenna branch and the fourth antenna branch is a concave side.

11. The antenna module according to claim 10, wherein a shape of the concave side edge is an arc; or the concave side edge comprises a first straight segment located in a middle region, and a second straight segment and a third straight segment located in two side regions, wherein an included angle between the second straight segment and the first straight segment is an obtuse angle, and an included angle between the third straight segment and the first straight segment is an obtuse angle.

12. The antenna module according to claim 11, wherein the floor is provided with a first feeder slot and a second feeder slot; and the third feeder extends through the first feeder slot and is connected to the radio frequency integrated circuit, and the fourth feeder extends through the second feeder slot and is connected to the radio frequency integrated circuit, wherein there is a gap between either of the third feeder or the fourth feeder and the floor.

13. The antenna module according to claim 9, wherein the third feeder comprises a first segment located in the first feeder slot and a second segment located between the third antenna branch and the floor, wherein a width of the first segment is smaller than that of the second segment, and a position of the second segment adjacent to the first segment is provided with a first corner cut; and the fourth feeder comprises a third segment located in the second feeder slot and a fourth segment located between the fourth antenna branch and the floor, wherein a width of the third segment is smaller than that of the fourth segment, and a position of the fourth segment adjacent to the third segment is provided with a second corner cut.

14. The antenna module according to claim 13, wherein a position of the second segment adjacent to the third antenna branch is provided with a third corner cut; and a position of the fourth segment adjacent to the fourth antenna branch is provided with a fourth corner cut.

15. The antenna module according to claim 9, wherein a shape of the third antenna branch is an isosceles triangle, and an apex angle of the third antenna branch is connected to the third feeder; and a shape of the fourth antenna branch is an isosceles triangle, and an apex angle of the fourth antenna branch is connected to the fourth feeder.

16. The antenna module according to claim 8, wherein the antenna module further comprises N directors, wherein the N directors are disposed in the substrate and the N dipole antenna units are disposed in one-to-one correspondence with the N directors.

17. The antenna module according to claim 16, wherein the director comprises a first vertical directing branch, a second vertical directing branch, a first horizontal directing branch, and a second horizontal directing branch, wherein the first vertical directing branch, the second vertical directing branch, the first horizontal directing branch, and the second horizontal directing branch are disposed at intervals.

18. An electronic device, comprising an antenna module, wherein the antenna module comprises:

a substrate, comprising a floor, a first dielectric layer, and a second dielectric layer, wherein the first dielectric layer and the second dielectric layer are located on two sides of the floor, respectively;

a millimeter wave antenna array, comprising N dipole antenna units, wherein the N dipole antenna units are successively disposed at an interval along the substrate, and N is an integer greater than 1;

a radio frequency integrated circuit, wherein the radio frequency integrated circuit is disposed on the first dielectric layer and is connected to feeding structures of the N dipole antenna units; and a non-millimeter wave antenna, wherein the non-millimeter wave antenna is disposed on the second dielectric layer wherein a connector of the antenna module is connected to a main board of the electronic device.

19. The electronic device according to claim 18, wherein the non-millimeter wave antenna is flush with an outer surface of the second dielectric layer.

20. The electronic device according to claim 18, wherein a type of the non-millimeter wave antenna is a patch antenna, a planar inverted-F antenna, or a loop antenna.

* * * * *